United States Patent [19]

Van Arnhem

[11] Patent Number: 4,457,357

[45] Date of Patent: Jul. 3, 1984

[54] AIR-CONDITIONING APPARATUS

[76] Inventor: Peter D. Van Arnhem, 2446 Cawthra Rd., Mississauga, Ontario, Canada, L5A 3K6

[21] Appl. No.: 338,914

[22] Filed: Jan. 12, 1982

[51] Int. Cl.[3] ..... F24F 3/14

[52] U.S. Cl. ..... 165/21; 165/16; 165/22; 236/44 R

[58] Field of Search ..... 165/21, 16, 3, 22; 62/176.6, 410, 177, 176.1, 176.3; 236/44 R, 44 G

[56] References Cited

U.S. PATENT DOCUMENTS

| | | | |
|---|---|---|---|
| 1,949,735 | 3/1934 | Bulkley | 257/8 |
| 2,216,475 | 10/1940 | Metcalf | 165/16 |
| 2,249,484 | 7/1941 | Miller et al. | 236/44 R |
| 2,257,462 | 9/1941 | Gildersleeve et al. | 165/16 |
| 2,279,787 | 4/1942 | Huggins | 236/44 R |
| 2,296,741 | 9/1942 | Sanders | 62/6 |
| 2,681,182 | 6/1954 | McGrath | 165/22 |
| 2,930,593 | 3/1960 | Blum | 165/22 |
| 3,402,760 | 9/1968 | Cohen | 165/21 |
| 3,631,686 | 1/1972 | Kautz | 62/173 |
| 4,105,063 | 8/1978 | Bergt | 165/21 |
| 4,142,574 | 3/1979 | Shavit | 165/21 |
| 4,157,112 | 6/1979 | Swiderski | 165/2 |
| 4,184,341 | 1/1980 | Friedman | 62/175 |
| 4,300,623 | 11/1981 | Meckler | 165/16 |
| 4,347,708 | 9/1982 | Bussjager | 165/16 |

OTHER PUBLICATIONS

Honeywell Brochure 60-2301-6 (Rev. 4-77).

*Primary Examiner*—Allen M. Ostrager
*Assistant Examiner*—Stephen F. Husar
*Attorney, Agent, or Firm*—Ridout & Maybee

[57] ABSTRACT

An auxiliary air cooling unit cools and dehumidifies air entering an air-conditioned building. The auxiliary unit operates in response to increased temperature and/or moisture content of the outside air to prevent air of undesirably high moisture content from entering the building. As the auxiliary unit operates selectively during periods of increased cooling load, it avoids or reduces problems of over-cooling of the air in the building by the main air-conditioning unit and reduces the need for periods of inefficient reduced-power operation of the main unit.

12 Claims, 2 Drawing Figures

AIR-CONDITIONING APPARATUS

Figure 1:
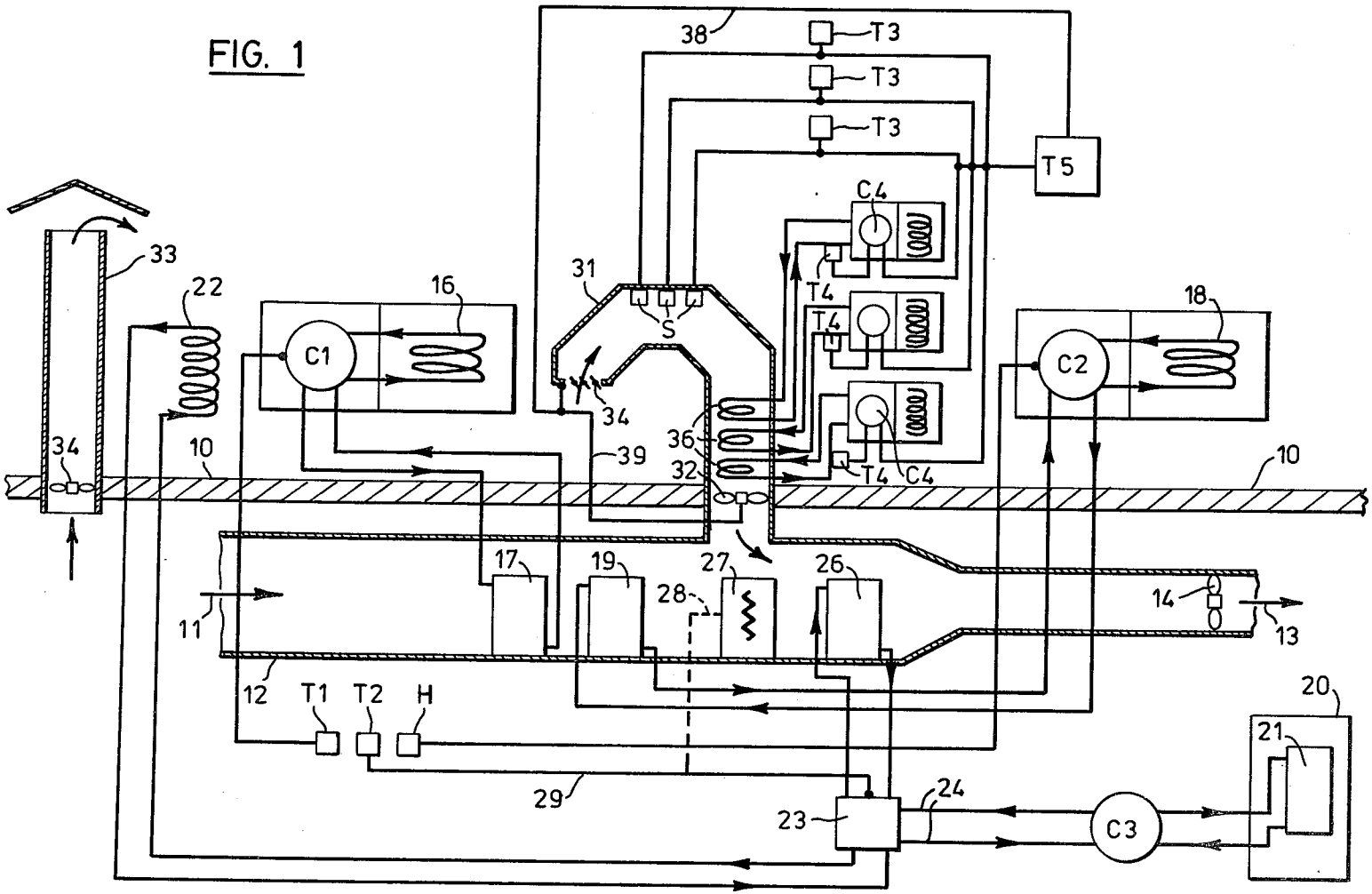

The present invention relates to air-conditioning apparatus for buildings, such as supermarkets, having refrigeration equipment including cooling elements exposed to the air within the building. In large supermarket buildings, it is normally desired to maintain the temperature and relative humidity at constant values which will be comfortable for users of the building and at the same time will avoid excessive frost build-up on the open refrigerator cases and freezers usually employed in such buildings. Typical values of relative humidity and temperature which are desired to be maintained in supermarket buildings are 35% relative humidity and 75° F. on a year-round basis. These conditions provide for good user comfort and at the same time reduce frost build-up on refrigeration equipment to within acceptable limits.

In a conventional air-conditioning installation in a supermarket building, air from within the building is re-circulated through an air-cooling unit which serves the functions of cooling and dehumidifying the air. It is required that a certain flow of outside air should be introduced into the building, at least during occupied hours, in order to ventilate the premises, and in order to replace air vented to the outside by exhaust fans which will comprise constantly-operating exhausts such as washroom exhaust fans and intermittently-operating exhaust fans such as those associated with cooking equipment within the premises e.g. barbeque exhausts, donut fryer exhausts, and bakery hood exhausts.

Typically, the outside air is mixed with the recirculating inside air before passing through the air-cooling-/dehumidifying unit. The latter is usually controlled by a thermostat and a relative humidistat located in contact with the air within the building so that cooling is applied to the blended mixture of outside and inside air whenever the temperature or the relative humidity within the building rises above a predetermined limit, the cooling in the latter case serving to cool the air to below its dew point, whereby moisture condenses out and the humidity of the air is reduced. Frequently, it is also necessary to include in the air-conditioning apparatus a heater controlled by a thermostat also located in contact with the air in the interior of the building, to heat the air when the temperature within the building drops below a certain limit.

This conventional method of handling the conditioning of the air within the building suffers from several drawbacks.

Firstly, as the air within the building must be kept at a relatively low humidity, the introduction into the building of outside air, often at a relatively high humidity, increases the humidity of the air and consequently more dehumidification is required in addition to simple cooling of the air. Typically, the amount of outside air introduced into the building is about 5% to 25% of the total volume of air passing through the cooling unit. This air is often at a relative humidity of 75% to 90%, whereas the air within the building is typically at a much lower humidity e.g. 35% relative humidity and 75° F.

A second disadvantage arises when only a slight amount of cooling or dehumidification arises, as the cooling unit is not readily and inexpensively adaptable to operating at reduced power. Typically, the cooling unit consists of a refrigeration circuit comprising a compressor working on a working fluid, with a condenser coil passing heat to the exterior of the building and an evaporator coil absorbing heat from the blended mixture of recirculating and outside air. Although means of reducing the amount of heat removed by the refrigeration are known, such as hot gas by-pass methods and compressor cylinder shut-down methods, these do not substantially reduce the amount of power required to operate the compressor, but only the amount of useful work done by the compressor.

Thirdly, often the only function required to be served by the air-conditioning unit is dehumidification. This would arise on days of high humidity, but of relatively moderate temperatures. For example, the outside air might be at a temperature of 75° and 95% relative humidity. Operation of the air-conditioning unit to reduce the relative humidity would substantially cool the air, making the interior premises of the building uncomfortable for its occupants. This over-cooling can be overcome by heating the air, at a consequent increase in the operating costs of the system.

The present invention provides an arrangement whereby these disadvantages can be reduced or avoided and, moreover, substantial energy savings may be obtainable as compared with the energy costs of operating the conventional units.

In the arrangement according to the invention, the incoming outside air is passed through an auxiliary air-cooling unit which operates under the control of controller means located in contact with the air on the exterior of the building and responding to the moisture content of the outside air. With this arrangement, the incoming air can be dehumidified by cooling it to a temperature below its dew point, so that the moisture content of the incoming air i.e. the weight of moisture per unit weight of incoming air (dry basis) can be reduced so that it at least more nearly approaches the moisture content which it is desired to maintain in the air within the interior of the building. It will usually be desirable that the auxiliary air cooling unit should serve the function of reducing the cooling load on the main air-cooling unit by reducing the sensible heat of the incoming air even on days of relatively low air moisture content but high outside temperature. It is therefore preferred to have the auxiliary controller means responding to both temperature and moisture content. Thus, for example, the auxiliary controller may comprise an enthalpy controller i.e. a controller responsive to the outside air's enthalpy i.e. the heat content, usually measured in Btu per pound of dry air and associated moisture. Enthalpy is thus a function of the moisture content and the dry bulb temperature of the air. Alternatively, the auxiliary controller may be a wet-bulb temperature thermostat, responsive to the wet-bulb temperature of the outside air, web-bulb temperature being also a function of the moisture content and dry-bulb temperature of the air. Or, as a further example, the auxiliary controller may be a dew point temperature thermostat responsive to the dew point of the outside air, dew point being a function only of the moisture content of the air.

By serving to dehumidify the incoming air, the auxiliary air cooler can reduce the amount of humidity entering the air-conditioned premises, thus reducing build-up of frost on refrigerators, freezers, and like cooling or refrigeration equipment located within the premises.

When the present arrangement is applied to modern energy-efficient buildings which are characterised by having an improved insulating building envelope and by efficient lighting systems generating minimal amounts of heat within the building, there may be no requirement for cooling or dehumidifying the air recirculating within the building, as all the heating load within the interior of the building may be absorbed by the cooling elements of refrigerator cases or like refrigeration equipment housed within the building. In such case the air within the building may be circulated through a main air treatment unit consisting only of air-heating elements which are actuated, normally only during periods of cold weather, when the temperature within the building drops below a pre-determined limit.

In less energy-efficient buildings, however, it will be desirable that provision should be made for cooling and dehumidifying the air circulating within the building and in such case the main air treatment unit will include air cooling and dehumidifying means. In this case, however, as the cooling and dehumidification load with the arrangement of the invention is divided between the main air-cooling unit and the auxiliary air-cooling unit, the former unit can be of reduced cooling capacity, and therefore the need for and periods of utilization of energy-wasteful reduced-power operation of the main cooling unit can be reduced. Further, during periods when only dehumidification of the incoming air is required, this dehumidification will, with the arrangement of the invention, be applied exclusively to the relatively smaller flow of incoming air so that periods of use of the main air-cooling unit as a dehumidifier will be reduced or eliminated, and therefore there will be a reduced tendency for the mass of air recirculating through the main cooler unit to become over-cooled, thus reducing the occasional need for reheating of the recirculating air.

Desirably, for increased operating efficiency of the apparatus, the auxiliary air-cooling unit comprises a plurality of separate compressor units and the auxiliary control means are arranged so that the compressors are brought into operation successively at progressively more severe conditions of dehumidification and cooling load. Each of the auxiliary compressors can then operate at conditions approaching or equal to its condition of maximum operating efficiency.

Figure 2:
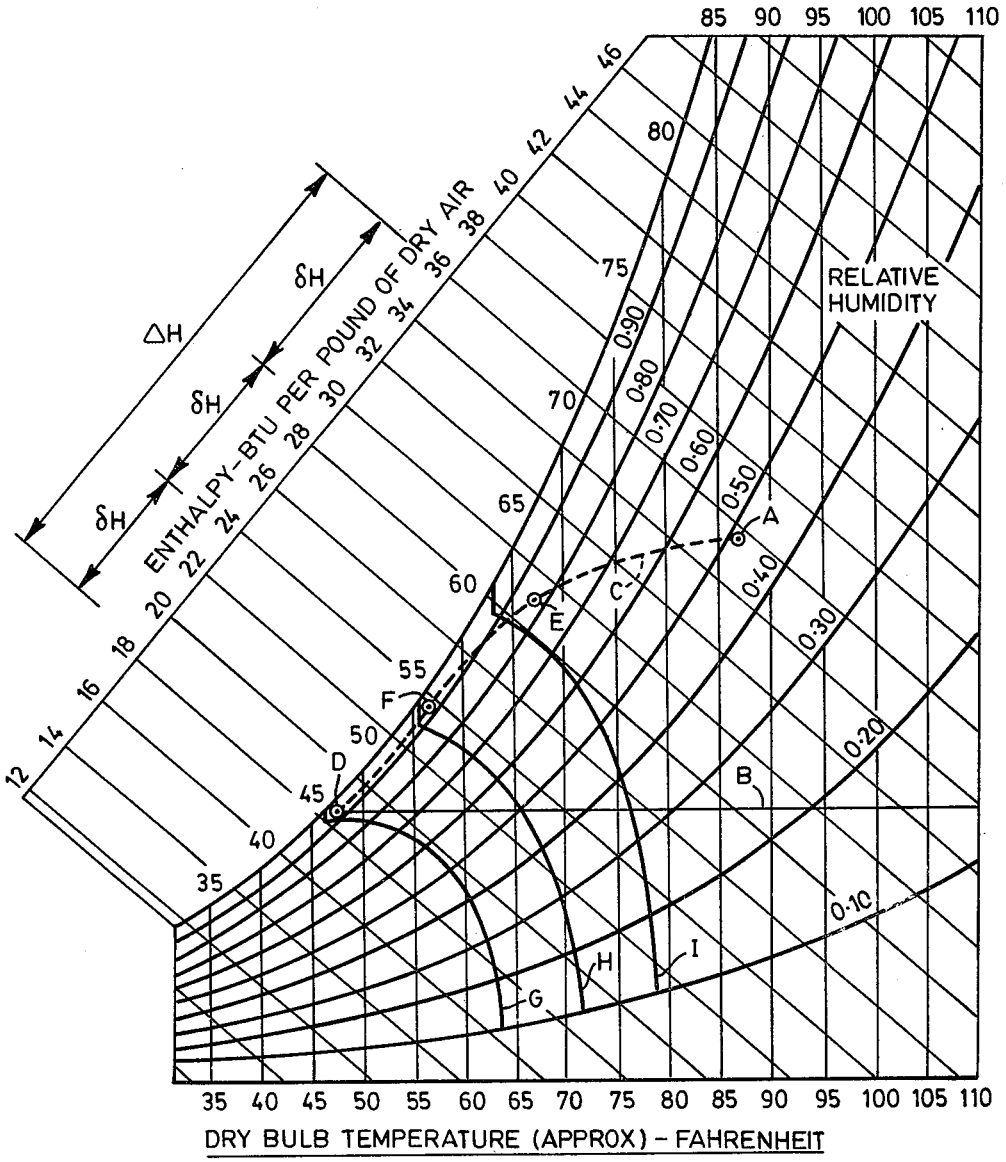

An example of apparatus in accordance with the invention is described hereinafter in more detail with reference to the accompanying drawings, in which:

FIG. 1 shows schematically one form of air-conditioning apparatus in accordance with the invention; and FIG. 2 shows a psychrometric chart illustrating the cooling and moisture content reduction effected by the auxiliary air-cooling means, and the ranges of actuation of the auxiliary controller means.

In the example shown in FIG. 1, an enclosed building, such as a supermarket store has a roof 10. Within the building, air represented by the arrow 11 is withdrawn from the inside of the building and passed through a duct 12 in which is contained a main air-cooling and dehumidifying unit. The cooled and dehumidified air, represented by the arrow 13, is recirculated to the inside of the building by a fan 14.

In this example, the main cooling and dehumidifying unit consists of two distinct stages each consisting of a refrigeration circuit. The first of these comprises a compressor $C_1$ operating on a working fluid and having a condensing coil 16 passing heat to the exterior of the building and a cooling coil 17 located within the duct 12. For the sake of conciseness of description, the expansion valve, check valves, and other control equipment associated with the refrigeration circuits have been omitted from the accompanying drawings, such equipment being purely conventional. The operation of the compressor $C_1$ is controlled by a thermostat $T_1$ located within the occupied space in the interior of the building, so that the compressor $C_1$ is actuated to bring into operation the cooling coil 17 when the temperature within the building rises above a predetermined limit. A further refrigeration circuit is provided comprising a compressor $C_2$, a condenser coil 18 and a cooling coil 19 located within the duct 12. The compressor $C_2$ is controlled by a relative humidistat H also located within the occupied space, and serving to energize the compressor $C_2$ and bring into operation the cooling coil 19 when the relative humidity within the building rises above a predetermined level. In a typical example, the thermostat $T_1$ is set to energize compressor $C_1$ when the temperature exceeds 75° F., and the humidistat H is set to energize compressor $C_2$ when the relative humidity exceeds 35% RH.

Although the main cooling and dehumidifying unit has been shown as two separate units, as will be apparent to those skilled in the art, the main cooling and dehumidifying unit may comprise a single refrigeration circuit operable either by the thermostat $T_1$ or the relative humidistat H, so that it is brought into action when either cooling or dehumidification are called for.

Usually, the equipment for air-conditioning the recirculating air within the duct 12 will include one or more reheating stages for heating the air circulating within the building when the temperature within the building drops below a certain limit. This re-heating may be called for when outside temperatures are low, or when, under conditions of relatively high outside relative humidity and low outside temperatures, when only dehumidification of the recirculating air is required. In the example illustrated, waste heat from a refrigeration case 20 within the building is employed for this re-heating. The refrigeration circuit associated with the refrigerator case 20 consists of a compressor $C_3$, an evaporator coil 21 within the refrigerator case and a condenser coil 22 located on the exterior of the building. A valving device 23 is connected across the working fluid lines 24 connecting the compressor with the condenser coil 22, and is actuated by a thermostat $T_2$ in contact with the air inside the building. The thermostat $T_2$ is set at a temperature normally a few degrees lower than the thermostat $T_1$ e.g. about 5° F. below the temperature of actuation of the thermostat $T_1$, so that, when the temperature inside the building drops below the temperature of actuation of the thermostat $T_2$, this actuates the valving device 23 to divert a proportion or all of the hot working fluid from the compressor $C_3$ to a re-heating coil 26 located within the duct 12. Further, or in the alternative, a separate heating element 27, such as an electrical heating coil or a gas or oil-fired heater, may be located within the duct 12, and arranged to be actuated by the thermostat $T_2$, as shown by the broken line connection 28 to the control line 29 connected to the thermostat $T_2$.

Usually, for increased efficiency of operation, it is desirable that the cooling coils 17 and 19 should be arranged within the duct 12 as shown so that a proportion, which may be between 0% to 90% of the air passing through the duct 12, bypasses the cooling coils 17 and 19.

When the present arrangement is applied to highly energy-efficient modern buildings where there is minimal heat load within the interior of the building which can readily be absorbed by cooling equipment such as refrigeration cases within the building it will not be necessary to provide for cooling of the air circulating through the duct 12 and in such case the cooling coils 17 and 19 and their associated compressors $C_1$ and $C_2$ may be omitted.

In order to provide ventilation air for persons occupying the building, and to replace air lost through exhaust from the building, outside air is drawn in through an air inlet duct 31 and is passed by a fan 32 to the interior of the main duct 12. For increased efficiency of operation, the incoming air blends with the recirculating air in the duct 12 at a point downstream from the cooling and dehumidifying coils 17 and 19, when present. In the preferred form, the fan 32 delivers air at a constant volume flow rate which is dictated by considerations of the number of persons normally occupying the building and the rate of loss of air from the building through exhaust fans. These exhaust fans will usually comprise washroom exhaust, and, in the case of supermarket buildings, will often also include cookery hood exhausts. In FIG. 1, the exhausts are represented by a vent pipe 33 and a fan 34 exhausting from the inside of the building. Normally, it is desired to maintain a slight positive pressure within the building to reduce entry of unconditioned air through entrances, doors, cracks, etc.

In the interior of the inlet duct 31 there are provided a plurality of auxiliary cooling coils 36, three in this example, to cool and dehumidify the air entering the building through the inlet duct 31. Each cooling coil 36 forms part of a separate refrigeration circuit comprising an auxiliary compressor $C_4$. The functioning of each of the compressors $C_4$ is controlled by a respective sensor S located in contact with the outside air. Each sensor S is pre-set to actuate its respective compressor C at a different value of the measured condition to which the sensor is responsive, so that the compressors C are actuated sequentially at progressively increasing values of the measured outside air condition. It is desired that the cooling coils 36 should serve to dehumidify the incoming air so that the moisture content of the incoming air, in terms of the weight of moisture contained in the air per unit weight or dry air, should approximate to the moisture content of the air-conditioned atmosphere which it is desired to maintain within the building.

In the preferred form the sensors S are enthalpy controllers that are responsive to both temperature and relative humidity and are pre-set so that they actuate their respective compressors $C_4$ at progressively higher conditions of enthalpy of the outside air.

Instead of using enthalpy controllers, the sensors S may instead be wet-bulb thermostats which are actuated when the outside wet-bulb temperature exceeds a predetermined limit, or dew point temperature thermostats which are actuated when the outside air dew point exceeds a predetermined limit. In each case, the sensors S will be pre-set so that their corresponding compressors $C_4$ are brought into action sequentially at progressively more severe conditions of the condition of the outside air to which the sensors S respond.

Since enthalpy controllers, as commercially available, are not very accurate, in order to prevent the compressors $C_4$ from being actuated at inappropriate conditions of the outside air, it is preferred to provide the compressors $C_4$ with dry-bulb thermostatic temperature controls $T_3$. The controls $T_3$ are set to permit actuation of the compressors $C_4$ at progressively higher temperatures in the same sequence as that determined by the sensors S. It is also preferred to provide thermostatic controls on the compressors $C_4$ such as the controls $T_3$ when the sensors S are wet-bulb thermostats or dew point temperature thermostats, in order to limit the minimum temperatures at which the compressors $C_4$ can be brought into operation.

In order to increase the operating efficiency of the auxiliary unit, the auxiliary compressors $C_4$ are preferably of the kind which are operable selectively at higher and lower cooling capacities, the motors of the compressors being operable selectively at high or low speed. To control the cooling capacity of each compressor $C_4$, a suction pressure controller, $T_4$ e.g. a temperature-responsive or pressure-responsive switch, is applied on the line returning working fluid to the compressor on the suction side of the compressor and is adapted to switch the compressor $C_4$ to its lower speed when the suction pressure (as indicated by the temperature or pressure of the working fluid) falls below a predetermined limit. In this manner, each of the compressors $C_4$ can be switched to a lower speed when the cooling load on its cooling coil 36 is low.

Instead of employing two-speed compressors as the auxiliary compressors $C_4$ it would be possible to employ compressors provided with such means of cooling capacity reduction as hot gas by-passing or cylinder unloading, selectively actuated by suction pressure control, but these methods of reduction of cooling capacity are much less energy efficient.

Further, it would be possible to use a single compressor in conjunction with the cooling coils 36 in place of the multiple compressors $C_4$ but such single compressor would need to be of large cooling capacity in order to deal with seasonal changes in cooling load and to be capable of handling extreme temperature and humidity conditions during summer-time operation, so that during the more usually-encountered periods of medium cooling load there would be a tendency for excessive frost build-up to occur on the cooling coil 36. Further, the unit would consume excessive amounts of power during periods of low and medium cooling load. By dividing the cooling load between a number of distinct compressor units, a variable cooling capacity can be provided so that the unit can accomodate the cooling load to which the cooling coil 36 is subjected, and the consumption of power by the cooling unit can be reduced.

The use of a number of distinct cooling coils 36, improves the energy consumption efficiency and facilitates defrosting, although the need for a large number of cooling stages to accommodate seasonal changes in cooling load can be reduced to some extent by employing 2 speed compressors, as noted above. In practice, the number of distinct cooling stages to be employed will be limited by the unit cost of the individual cooling units, to effect a compromise between the increased capital cost of providing a number of distinct units and the operating cost savings of increased seasonal energy-consumption efficiency. In practice, under usual conditions of seasonal climatic changes, at least in North America, the use of 3 or 4 distinct cooling stages will be appropriate.

It will be appreciated that the arrangement shown in the drawings may be further modified by employing auxiliary heating coils within the duct 31 following the cooling and dehumidifying coils 36, these auxiliary heating coils being connected through a diverting valve arrangement similar to the valve 23, under the control of the thermostat $T_2$, to the compression side of the compressors $C_4$, whereby when the temperature within the building drops below a predetermined limit, the hot working fluid from the compressor $C_4$ passes to the auxiliary heating coils and heats the incoming dehumidified air coming from the coils 36.

Although the above description provides ample information to one skilled in the art to enable him to carry out the invention, for the avoidance of doubt, a detailed Example of one form of the air-conditioning apparatus of the invention will now be given.

EXAMPLE

In this example, the apparatus is assumed to be applied to a supermarket store with 30,000 sq. ft. sales area. Utilizing apparatus as shown in FIG. 1 of the accompanying drawings, the amount of air to be introduced by the constant flow rate fan 32 is selected taking into consideration (a) the ventilation air required for people inside the store, (b) the amount of air exhausted through continuously-operating exhausts from the building and (c) the amount of air exhausted through intermittently-operating exhausts from the building. Standard codes dictate that a minimum of 5 cubic ft. per minute per person be introduced into the building as sufficient ventilation air for the occupants of the building. Assuming a reasonable occupation density of 1 person per hundred sq. ft. of gross sales area the amount of ventilation air required is 1,500 cubic ft. per minute. Added to this is the air required to replace continuously-operating exhausts from the building such as washroom exhausts and other continuously-operating exhaust fans, and the air required to replace intermittently-operating exhaust fans such as barbeque exhausts, donut fryer exhausts, bakery hood exhausts, and other cooking hood exhausts.

From consideration of these factors, an appropriate figure for the amount of air to be introduced into the building can be selected. Usually, it is preferred to slightly increase the quantity thus determined by about 10% in order to provide a slight positive pressure within the building in order to reduce entry of unconditioned air into the building through entrances, doors, cracks, etc. In this example, it is therefore assumed that the amount of air required to be delivered by the air inlet fan 32 is 2,750 cubic ft. of outside air per minute.

In selecting the cooling capacity required for the auxiliary cooling and dehumidifying unit, reference is made to the standard air-conditioning summer design conditions for the location in which the building is situated. These design conditions indicate the percentage of the time during the summer time during which cooling loads exceed a certain level. For example, the standard American Society of Heating Refrigeration and Air-Conditioning Engineers summer design conditions for Toronto indicate that the 2½% summer design condition for Toronto is 87° F. dry-bulb and 72° F. wet-bulb i.e. these dry-bulb and wet-bulb temperatures are exceeded for 2½% of the summer time in Toronto. Desirably, the cooling capacity of the auxiliary unit is selected so that it at least matches the difference in enthalpy between air at the condition required to be maintained within the building and the 10% summer design condition, more preferably the 5% summer design condition, at the location of the building.

In this example, the 2½% summer design condition will be employed (87° F. dry bulb and 72° F. wet bulb).

As shown on the psychrometric chart of FIG. 2, representing graphically the properties of mixtures of air and water vapor at standard pressure (29.92 inches of mercury) air at the 2½% summer design condition is represented by point A.

The moisture content of air at the desired condition of 75° F. and 35% relative humidity is represented by line B. The standard cooling curve line C is now drawn in, (shown by a broken line in FIG. 2) representing the conditions that air at point A inevitably follows as it passes through the cooling coil of a heat exhanger. The line C meets line B at point D. The required cooling capacity for the auxiliary cooling and dehumidifying unit is therefore ΔH, representing the difference in enthalpy between air at point A and air at point D (the point of coincidence of line B with the standard cooling curve C).

The amount of total heat to be removed can now be determined from the formula:

| | |
|---|---|
| O.A.T.H. | = 4.45 × CFMoa × (hoa-hla) |
| where O.A.T.H. | = Outside Air Total Heat in B.T.U. |
| CFMoa | = Cubic Feet per minute of outside air |
| hoa | = Specific enthalpy of outside air in B.T.U. per pound of outside air. |
| hla | = Specific enthalpy of outside air in B.T.U. per pound of leaving air from cooling heat exhanger. |
| 4.45 | = dimensionless constant relating volume of air in cubic feet to its weight in pounds. |
| hoa | = 35.8 (obtained from psychrometric chart) |
| hla | = 18.2 (obtained from psychrometric chart), and |
| CFMoa | = 2,750 (given) |
| Therefore: | |
| O.A.T.H. | = 4.45 × 2,750 × (35.8 − 18.2) B.T.U./hr. |
| | = 215,380 B.T.U./hr. |

The number of increments in which the stages of dehumidification is to be carried out is now selected. As discussed above, the number of stages of cooling is to be selected taking into account the capital cost of the separate refrigeration circuits and associated control components required, the availability of two-speed compressors or other variable cooling capacity components for use as the compressors $C_4$ and the arrangements required for periodic defrosting of the cooling coils 36, and the seasonal energy efficiency required for the system.

For the purposes of the present example, three cooling stages are employed, each comprising a LENNOX (trade mark) nominal 5 ton two-speed compressor, and therefore the heat load is divided into approximately 3 equal components represented by δH in FIG. 2. The first cooling coil 36 is intended to cool the outside air from point A to point E, the second coil 36 to cool the air from point E to point F and the third to cool the air from point F to point D, and it will be noted from the above calculation that the cooling capacity of each refrigeration circuit associated with the compressors $C_4$ should be approximately 72,000 B.T.U./hr.

In this example, the 3 compressors $C_4$ are turned on and off through enthalpy controllers S located in contact with the free incoming air. An example of a suitable enthalpy controller is the HONEYWELL (trade mark) enthalpy control H205A. The function of such enthalpy control is that it is responsive to dry-bulb temperature and relative humidity and is actuated to complete an electrical circuit when the dry-bulb temperature and relative humidity conditions exceed a predetermined range. The respective enthalpy controllers S are set so that one of these (connected to the compressor $C_4$ intended for cooling from point F to point D) actuates the compressor when the enthalpy of the outside air reaches approximately 18 B.T.U., the second enthalpy controller (for actuating the compressor intended for cooling from point E to point F) being set to actuate the compressor when the enthalpy of the outside air reaches approximately 23 B.T.U., and the third enthalpy controller being set to actuate its compressor, for cooling from point A to point E, when the outside enthalpy reaches approximately 29 B.T.U. The conditions under which the respective enthalpy controllers are actuated are represented in FIG. 2 by curves G, H, and I, respectively. When the conditions of both dry-bulb temperature and relative humidity lie rightwardly of these curves, the respective enthalpy controllers are actuated. As the commercially-available enthalpy controllers sometimes display some inaccuracies, it is preferred to subjugate the control of the compressors $C_4$ to low limit dry-bulb thermostat temperature controls $T_3$ to preclude operation of the respective compressors $C_4$ when the outside temperature falls below the preset limits. In this example, the thermostat $T_3$ for cooling stage F to D is set at 45° F., E to F at 55° F., and A to E at 64° F.

It will be noted that for proper functioning of the enthalpy controllers or other sensors S, these are connected directly to their respective compressors $C_4$ and serve to actuate the latter independently of the conditions within the store sensed by the controls $T_1$, $T_2$, and H.

With these compressors $C_4$ operating in the ideal design condition on incoming air at a dry-bulb temperature of about 87° F. and a relative humidity of about 49% the cooling capacities of the compressors $C_4$ are such that the suction temperture in the cooling coil 36 operating to cool the air from point A to point E will be about 50° F., in the coil 36 cooling from point E to point F will be about 45° F. and in the coil 36 cooling from point F to point D will be about 40° F.

Each compressor $C_4$ is equipped with a pressure or temperature-responsive switch $T_4$ applied on the suction side of the compressor and responding to the temperature (or pressure) of the working fluid returning to the suction side of the compressor. To avoid excessive frosting of the coils 36, each switch $T_4$ is set so that its respective compressor $C_4$ is switched to its lower speed of operation when the suction pressure falls to about 32° F.

Desirably, the compressors $C_4$ in the auxiliary unit are subjugated to the control of a time-switch T.S. so that the compressors $C_4$ can operate only during the occupied or business hours of the supermarket, and the time-switch T.S. also controls electrically-operated dampers 37 on the inlet duct 31 and the motor of the fan 32, through control lines 38 and 39, respectively, to switch off the fan 32 and close the dampers 37 to prevent outside air from being drawn into the store through the duct 31.

During un-occupied time periods, the main cooling unit 17, or refrigeration cases within the store will then serve to maintain the temperature of the air within the store at an acceptable level.

With the arrangement shown in the drawings, during occupied hours of the store, the cooling load required to maintain the desired conditions of temperature and relative humidity within the store is divided between the main unit and the auxiliary unit, and it is therefore possible to employ main cooling units 17 and 19 of cooling capacity substantially lower than would otherwise be demanded. Accordingly, for maximum efficiency of operation, main cooling units 17 and 19 should be selected to have a cooling capacity lower than would conventionally be dictated by considerations of floor area and expected number of persons occupying the store.

I claim:

1. Apparatus for air-conditioning a building having refrigeration equipment including cooling elements exposed to the air within the building, comprising a main air treatment unit including at least one air-heating element, means for circulating air within the building through the main unit, and a thermostat responsive to the temperature of air within the building to actuate the heating element when the temperature within the building falls below a predetermined limit, and an auxiliary air treatment unit including at least one air-cooling and dehumidifying element, means for passing air from the outside of the building through said auxiliary unit and into the building, and auxiliary controller means located in contact with the outside air and responding to moisture content of the outside air to actuate said air-cooling and dehumidifying element when said moisture content rises above a pre-determined limit thereof, said auxiliary controller means being directly operatively connected to said auxiliary unit and actuating the latter independently of the conditions existing within the building.

2. Apparatus as claimed in claim 1 wherein the auxiliary controller means comprise an enthalpy controller which is actuated when the outside dry-bulb temperature and relative humidity both exceed a pre-determined range.

3. Apparatus as claimed in claim 1 wherein the auxiliary controller means comprise a wet-bulb thermostat which is acutated when the outside wet-bulb temperature exceeds a pre-determined limit.

4. Apparatus as claimed in claim 1 wherein the auxiliary controller means comprise a dew point temperature thermostat which is actuated when the outside air dew point exceeds a pre-determined limit.

5. Apparatus as claimed in claim 2, 3, or 4 wherein the auxiliary controller means include a dry-bulb thermostat precluding actuation of said auxiliary unit when the outside air temperature is below a pre-determined limit.

6. Apparatus as claimed in claim 1 wherein said auxiliary unit comprises a plurality of separate air cooling and dehumidifying sub-units, and the auxiliary controller means comprise a corresponding plurality of subcontrollers set to actuate the respective sub-units at respective progressively higher values of said moisture content.

7. Apparatus as claimed in claim 1 wherein the means for passing air from the outside through said auxiliary unit deliver a constant flow rate of air.

8. Apparatus as claimed in claim 1 wherein said auxiliary unit comprises a refrigeration circuit employing a working fluid and including a compressor operable at higher and lower cooling capacities and including suction pressure-responsive means responsive to a fall in pressure of the working fluid on the suction side of the compressor to below a predetermined limit and switching the compressor to the lower cooling capacity.

9. Apparatus as claimed in claim 1 wherein said main air treatment unit includes at least one main air cooling and dehumidifying element, and main controller means are provided in contact with the air inside the building, said main controller means being responsive to at least one condition selected from the group consisting of temperature and relative humidity and actuating said at least one main air cooling and dehumidifying element when said at least one condition rises above a predetermined limit thereof.

10. Apparatus as claimed in claim 9 wherein said means passing air from the outside blend the incoming outside with the air circulating through the main unit after passage of the circulating air through said at least one main cooling and dehumidifying unit.

11. Apparatus for air-conditioning a building comprising: a main air-conditioning unit comprising at least one air cooling and dehumidifying element actuated by a temperature and relative humidity, and a heater unit actuated when the temperature inside the building falls below a pre-determined limit; means for circulating air within the building through the main air-conditioning unit; an auxiliary air cooling and dehumidifying unit comprising a plurality of distinct cooling stages providing for progressively greater cooling capacity as successive ones of said cooling stages are brought into operation; sensor means responding to the moisture content of air outside the building and adapted to bring a progressively greater number of said cooling stages into operation at progressively higher sensed values of said moisture content; and means for passing air from the outside of the building through said auxiliary unit and into the building.

12. Apparatus for air-conditioning a building having refrigeration equipment including cooling elements exposed to the air within the building, comprising a main air treatment unit including at least one air-heating element, means for circulating air within the building through the main unit, and a thermostat responsive to the temperature of air within the building to actuate the heating element when the temperature within the building falls below a predetemined limit, a duct communicating between the outside and the inside of the building, means for drawing air from the outside of the building, through the duct and into the inside of the building, an auxiliary air treatment unit including at least one air-cooling and dehumidifying element within the duct, and auxiliary controller means located in contact with the air passing through the duct and responding to moisture content of the air passing through the duct to actuate said air-cooling and dehumidifying element when said moisture content rises above a predetermined limit thereof, said auxiliary controller means being directly operatively connected to said auxiliary unit and actuating the latter independently of the conditions existing within the building.

* * * * *